US010907356B2

(12) United States Patent
Mechler et al.

(10) Patent No.: US 10,907,356 B2
(45) Date of Patent: Feb. 2, 2021

(54) ROOF DRAIN

(71) Applicant: RPH intellectual Holdings, LLC, San Antonio, TX (US)

(72) Inventors: Stephen L. Mechler, San Antonio, TX (US); Tom D Knight, San Antonio, TX (US); John R Barbieri, Jr., Wyncote, PA (US)

( * ) Notice: Subject to any disclaimer, the term of this patent is extended or adjusted under 35 U.S.C. 154(b) by 0 days.

(21) Appl. No.: 16/446,132

(22) Filed: Jun. 19, 2019

(65) Prior Publication Data

US 2019/0383020 A1 Dec. 19, 2019

Related U.S. Application Data

(60) Provisional application No. 62/686,750, filed on Jun. 19, 2018.

(51) Int. Cl.
*E04D 13/04* (2006.01)
*E03F 5/06* (2006.01)

(52) U.S. Cl.
CPC ..... *E04D 13/0409* (2013.01); *E03F 5/06* (2013.01); *E04D 2013/0413* (2013.01)

(58) Field of Classification Search
CPC ..... E04D 13/0409; E04D 2013/0409; E04D 2013/0413; E03F 5/04; E03F 5/06
USPC ..... 210/163, 170.03; 52/302.1
See application file for complete search history.

(56) References Cited

U.S. PATENT DOCUMENTS 902,289 A * 10/1908 Gribben ..... F24F 13/02 210/163
1,999,277 A * 4/1935 Boosey ..... E04D 13/0409 210/163
2,079,269 A * 5/1937 Williams ..... E04D 13/0409 210/163
5,724,777 A * 3/1998 Hubbard ..... E04D 13/0409 210/163
6,165,357 A * 12/2000 Cormier ..... E04D 13/0409 210/163
2003/0201217 A1* 10/2003 Dresmann ..... E04D 13/0409 210/163

FOREIGN PATENT DOCUMENTS

EP 3103937 * 12/2016

* cited by examiner

*Primary Examiner* — Christopher Upton
(74) *Attorney, Agent, or Firm* — Gunn, Lee & Cave, PC

(57) ABSTRACT

The present invention is a roof drain assembly that comprises a dome mounted to a drain body by shock arrestors and a roof clamp that is securable to the drain body. A screen is positioned around the inlet and between the drain body and the dome. The shock arrestors and screen permit the dome to compress against the drain body while simultaneously absorbing the energy from an impact. As the shock arrestors compress, the screen also compresses. The resiliency of the screen and the shock arrestors permit the dome assembly to return to its passive state once the compression force is removed.

18 Claims, 5 Drawing Sheets

ROOF DRAIN

CROSS REFERENCES TO RELATED APPLICATIONS

This application claims the benefit of U.S. Provisional Application Ser. No. 62/686,750 filed Jun. 19, 2018 entitled Roof Drain which is incorporated by reference herein.

FEDERALLY SPONSORED RESEARCH

Not applicable.

BACKGROUND OF THE INVENTION

1. Field of the Invention

This invention relates generally to construction. More specifically, the invention relates to a roof drain.

2. Description of the Related Art

Roof drains control the flow of water on a roof and are especially necessary for roofs that are generally flat without any significant degree of slope. A roof drain collects water from the top of the roof deck and funnels the water through an outlet that connects to a drainage system. A properly installed roof drain protects the roof deck from water penetration and quickly removes water from the roof to eliminate weight problems. Roof drains come in a variety of different designs and may be mounted to the roof decking and/or secured through clamping to the roof deck. A grate is typically installed above and around the inlet to prevent large debris from clogging up the inlet. Each roof drain further comprises an outlet that connects to the drainage system.

Commonly installed roof drains are susceptible to damage from storm debris and hail. If the grate is damaged, large debris may clog the inlet preventing water from draining from the roof. This may result in a weakened roof due to the weight of the water. Damage from flying debris may also damage the roof drain by disrupting the mounting to the roof deck. Such damage may result in roof leaks which make the roof susceptible to collapse.

Building codes for storm shelters in certain areas prone to tornadoes and hurricanes (ICC-500 (2014) and FEMA P-361 safe room/storm shelter specifications) were enhanced to require roof drains to withstand debris flying at 250 mph. As a result, there is a need to satisfy the new building codes (specifically ICC 2014-500) related to the construction of storm shelters for tornado and hurricane construction.

In light of the foregoing, there is a need for an off the shelf roof drain to meet building codes for tornado and hurricane winds and related debris.

BRIEF SUMMARY

The present invention is a roof drain designed to withstand debris flying at 250 mph and meet enhanced safety specifications for safe rooms such as ICC-500 (2014) and FEMA P-361 safe room/storm shelter specifications. The drain comprises a dome assembly mounted to a drain body by shock arrestors. The shock arrestors permit the dome assembly to compress from a high speed impact without damaging the subdrain assembly and/or roof.

DETAILED DESCRIPTION OF CERTAIN EMBODIMENTS

Figure 1:
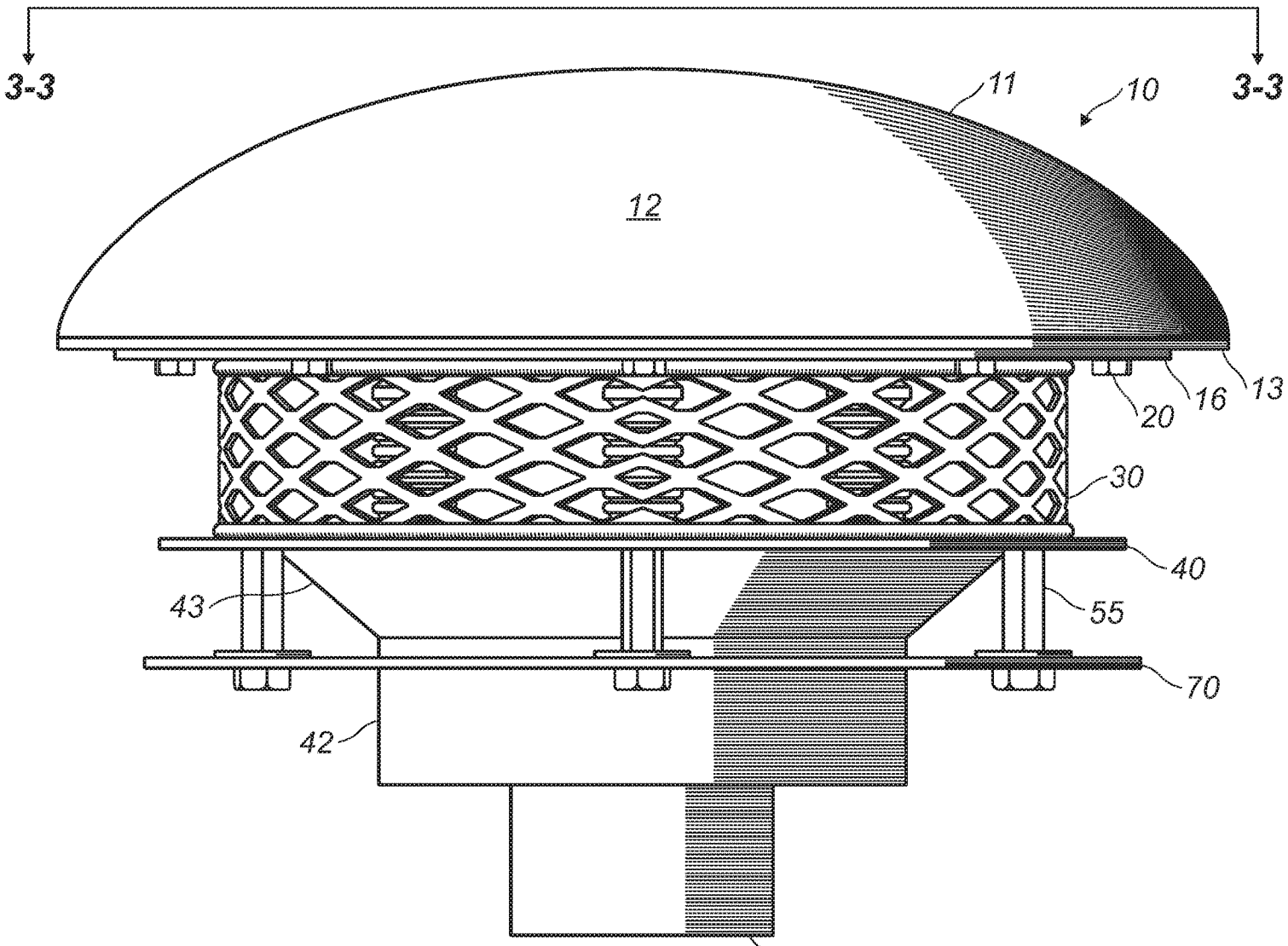
FIG. 1 shows a side view of an embodiment of the invention.
Figure 2:
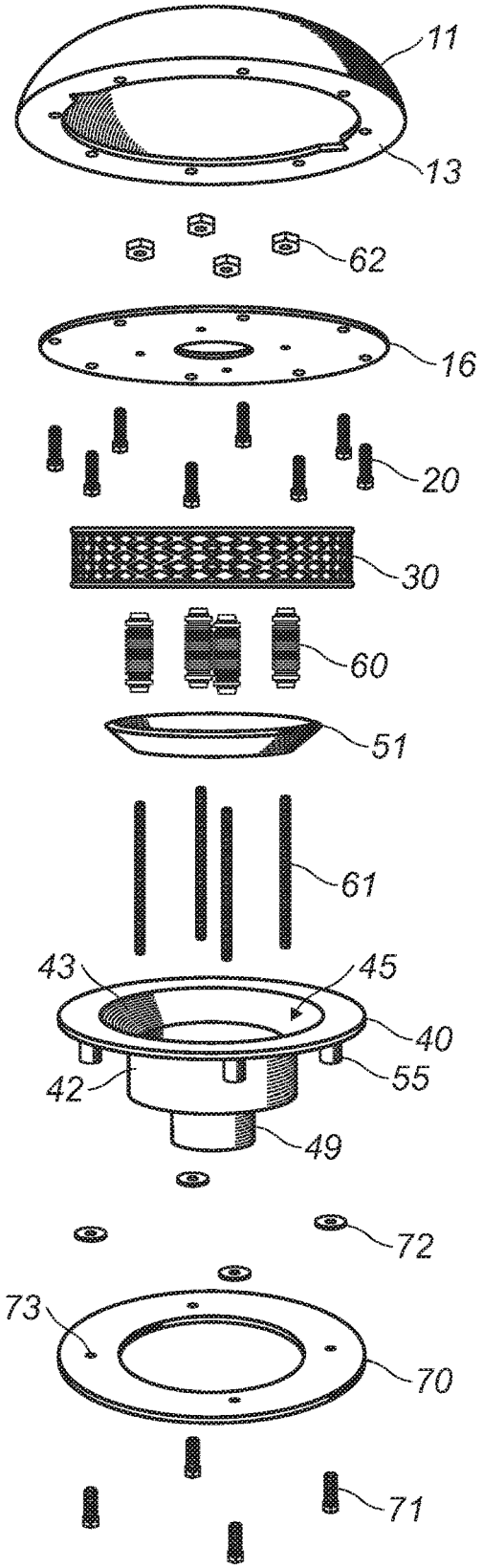
FIG. 2 is an assembly view of the embodiment shown in FIG. 1.
Figure 3:
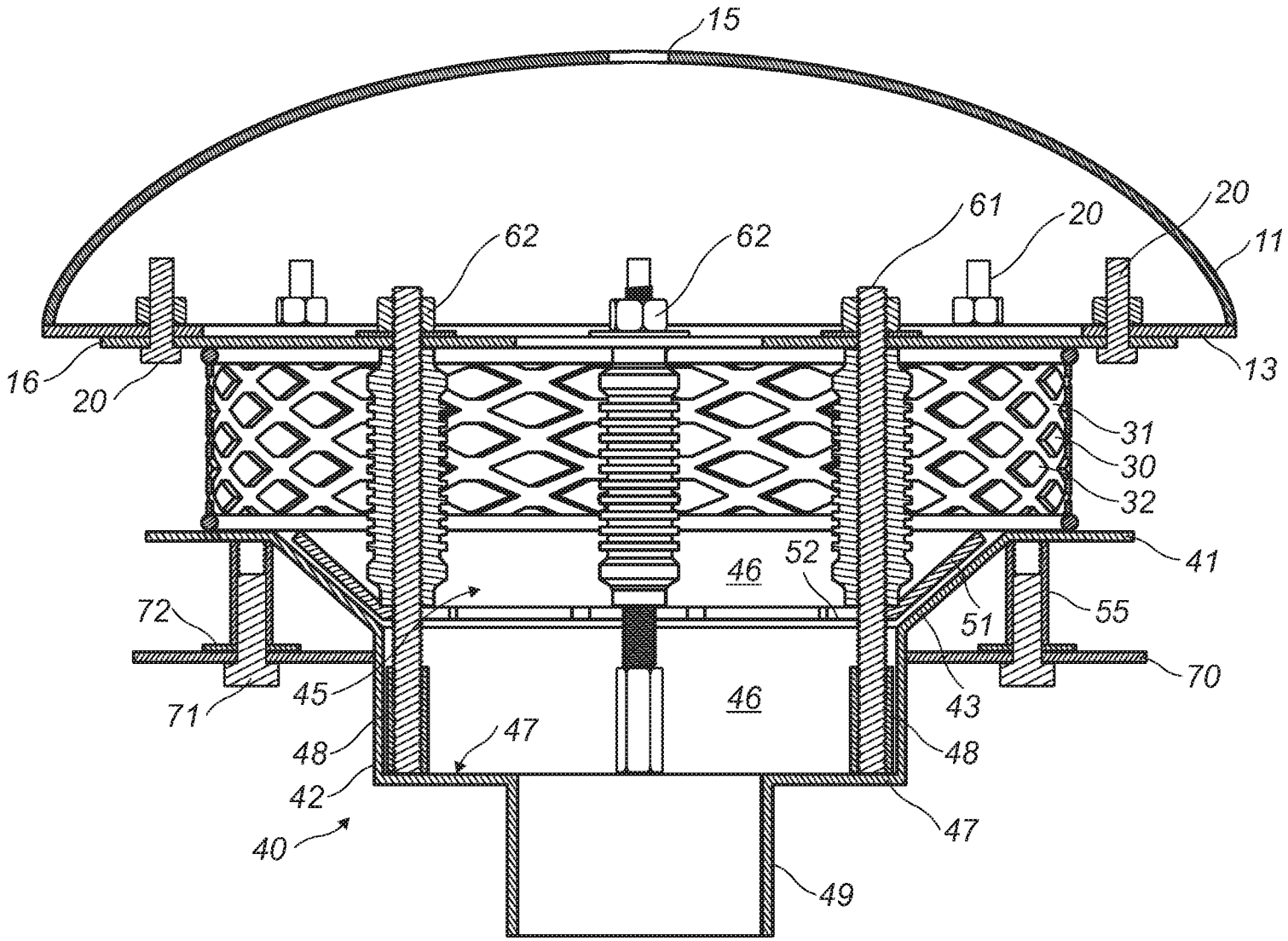
FIG. 3 is a cross section through line 3-3 of FIG. 1.
Figure 4:
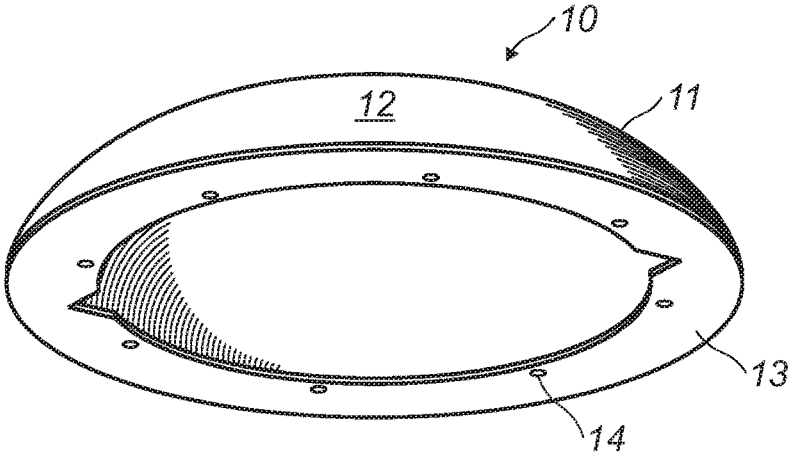
FIG. 4 is a perspective view of the dome.
Figure 5:
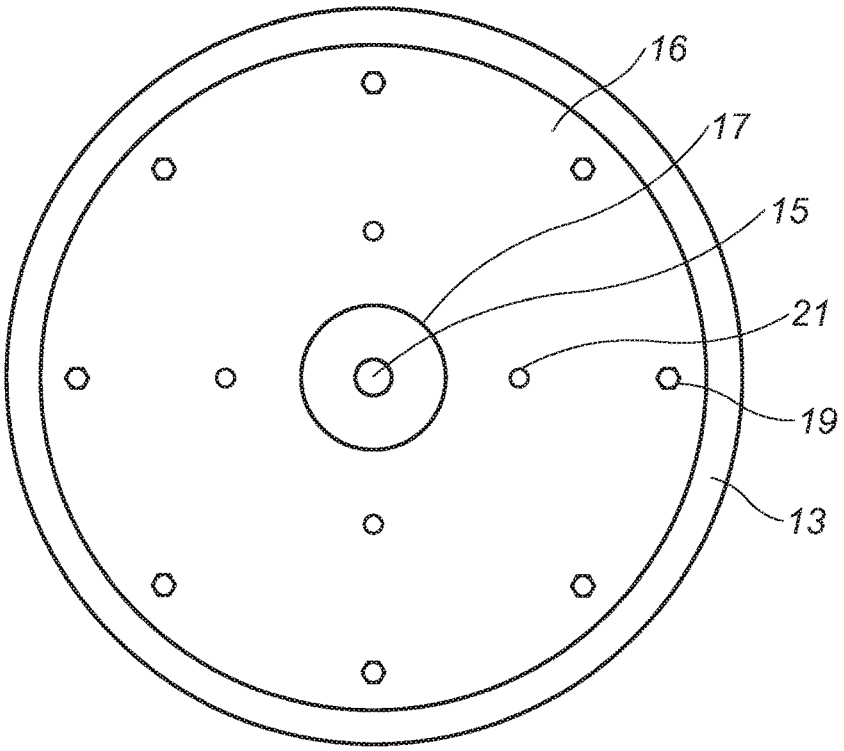
FIG. 5 is a bottom view of the dome assembly without fasteners.
Figure 6:
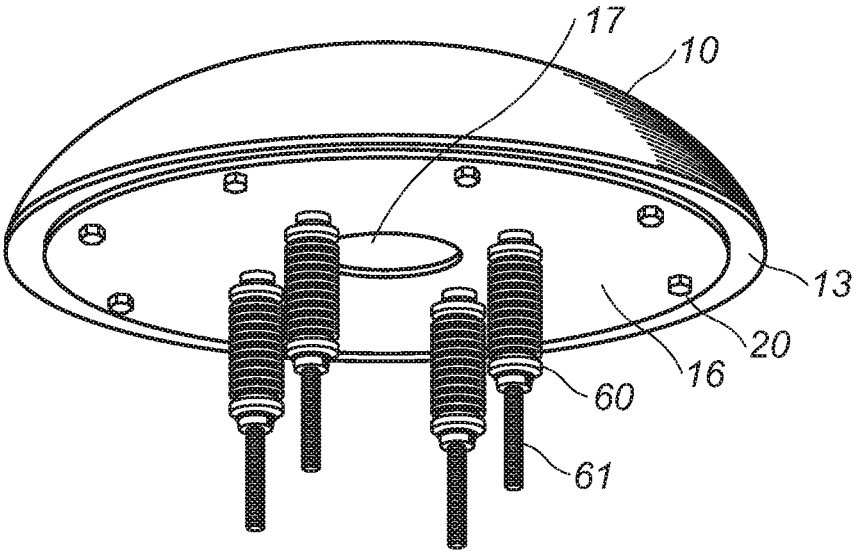
FIG. 6 is a perspective view of the bottom of the dome assembly with the threaded rod and arrestors mounted to the plate.

As seen in FIGS. 1-3, the roof drain 1 comprises a dome assembly 10, screen 30, drain body 40, tapered insert 51, and a roof clamp 70.

As seen in FIGS. 1-5, the dome assembly 10 comprises a dome 11 having a rounded top surface 12 and an interior flange 13 extending from the bottom edge of the rounded top surface 12. The top surface may be colored to have solar resistance. The flange 13 is planer and has flange holes 14. A hole 15 is positioned at the apex of the rounded top surface 12. A circular plate 16, having a diameter approximately equal to the diameter of the dome 11, has a large opening 17 in the middle, threaded rod bores 21 near the opening 17, and fastener holes 19 disposed around the outer edge. The fastener holes 19 correspond to the flange holes 14 such that the circular plate 16 is mounted to the bottom surface of the flange 13 with by a fastener 20 extending though fastener holes 19 and flange holes 14.

The drain body 40 comprises a roof flashing flange 41 encompassing an inlet 45, an inner surface 46, a sidewall 42 having a tapered portion 43 and an interior ledge 47, and an outlet 49. The roof flashing flange 41, inlet 45, sidewall 42, and outlet 49 are generally circular. The roof flashing flange 41 has a smaller diameter than the dome 11. Extending perpendicularly from the bottom surface of the roof flashing flange 41 are threaded bolt receivers 55. Extending from the top surface of the interior ledge 47 are threaded bolt receivers 48.

Figure 7:
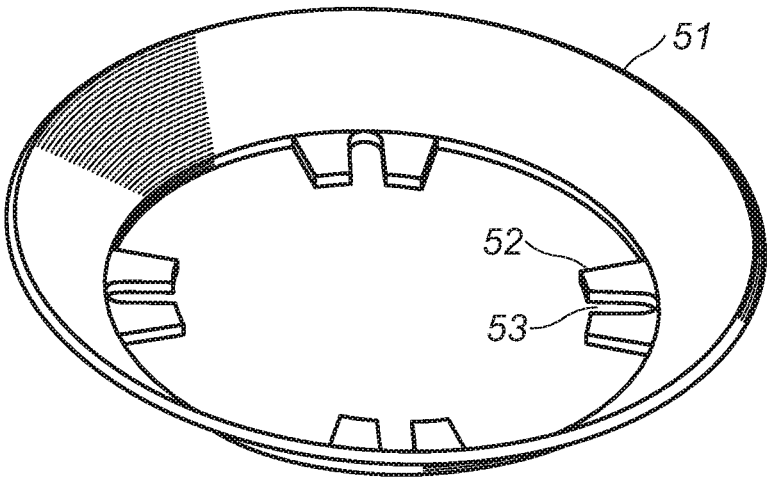
FIG. 7 is a view of the tapered insert.

As seen in FIGS. 2,3, and 7, a tapered insert 51 having brackets 52 with bores 53 is positioned within the drain body 40 near the inlet 45. The tapered insert 51 corresponds to the tapered portion 43 of the sidewall 42. Each bracket 52 is positioned in line with the threaded bolt receivers 48 such that the bore 53 matches with the opening of the threaded bolt receiver 48.

As seen in FIGS. 1-3, and 6, a threaded rod 61 connects to the threaded bolt receivers 48 and is positioned within the bore 53 of the bracket 52. The threaded rod 61 extends through a shock arrestor 60 such that the bottom of the shock arrestor rests on the top of the bracket 52. The opposite end of the threaded rod 61 is positioned through the threaded rod bore 21 of plate 16. The top of the shock arrestor 60 abuts the bottom surface of the plate 16. A fastener 62, such as a bolt and washer, secures the plate 16 to the top of the shock arrestor 60. In the preferred embodiment the shock arrestor is manufactured of polyurethane. In the disclosed embodiment the shock arrestors are positioned on the interior of the drain body such that the brackets and mounting hardware are not touching or abutting the roof flashing flange 41. Alternative embodiments may use shock arrestors positioned on the roof flashing flange. In the disclosed embodiment, the dome assembly rests on top of the shock arrestors with no compression force applied except for the weight of the dome assembly. In alternative embodiments, the dome assembly may be attached to the arrestors to invoke some compression, in addition to gravity. In the disclosed embodiment, four arrestors are disclosed. Depending on the desired height of the dome assembly and expected volume of fluid intake the drain is designed for, any number of arrestors including only one arrestor.

A screen 30 is positioned between the bottom surface of the plate 16 and the top surface of the roof flashing flange 41. The screen 30 features a diamond mesh pattern 31 which provides multiple holes 32 to allow permeability of fluid. The diamond mesh pattern 31 permits the screen 30 to compress under stress. The diameter of the screen 30 is less than the diameter of the roof flashing flange 41 and the plate 16. In the preferred embodiment, the distance between the roof flashing flange 41 and the plate 16 is approximately 4 inches. Alternative patterns of the screen may be used such as circles or squares. The screen 30 is generally constructed of a lightweight metal to allow for compression, and subsequent resiliency, but any material suitable for compression without substantial distortion of the pattern or material upon compression is suitable.

A roof clamp 70 is positioned below roof flashing flange 41. The roof clamp 70 has bores 73 that correspond to the threaded bolt receivers 55. A fastener, such as a bolt 71 with a washer 72 secures the roof clamp 70 to the bottom of the roof flashing flange 41. In operation, the roof clamp is positioned on the underside of the roof deck while the underside of the roof flashing flange 41 is positioned on top of the roof deck. The length of the fastener may be variable based on the thickness of the roof deck. Upon installation, the roof flashing flange, 40, screen 30 and the dome assembly are exposed to the elements.

In operation, water passes through the screen 30 and enters the inlet 45 where it passes through the inner tapered surface and out the outlet 49. Typically the outlet 49 is connected to internal piping within the building to safely remove the water from the building. Due to the size/diameter of the dome 11 relatively to the drain body, if debris strikes the roof drain the impact will likely occur to the dome. The dome's shape causes the debris to deflect away from the dome and thus provides a small surface area for direct impact. To the extent the impact of the debris is at high velocity, the dome assembly compresses generally toward the roof flashing flange. This causes the shock arrestors and the screen to absorb energy as the shock absorber compresses against the bracket 52 and the screen compresses against the roof flashing. The arrestor closest to the impact generally absorbs the most energy and may compress more than the other arrestors. The resiliency of the screen and the shock arrestors permit the dome assembly to return to its passive state once the compression force is removed. The shape of the dome, the arrestors, and the compression of the screen deflect and/or absorb much of the impact thus reducing the potential for roof drain failure and reduces the stress of the impact on the roof deck itself. If the roof becomes flooded and causes water to rise over the edge of the dome, the hole 15 relieves any vacuum that might form and allow for continual drainage.

In the preferred embodiment, the dome 11, plate 16, drain body 40, and tapered insert 51 are manufactured of 3/16" carbon steel. Alternatively, the dome 11, plate 16, a in body 40, and tapered insert 51 may be manufactured of high performance fibers such as olefin yarn or other polymer.

Other shapes are contemplated other than a dome such as a multitude of angled panels. The preferred embodiment utilizes circular and dome shapes as they are more efficient for collecting water and for deflecting impacts.

The present invention is described in terms of specifically-described embodiments. Those skilled in the art will recognize that other embodiments of such device can be used in carrying out the present invention. Other aspects and advantages of the present invention may be obtained from a study of this disclosure and the drawings, along with the appended claims.

We claim:

1. A roof drain comprising:

a drain body having an inlet and an outlet;

a cover secured to the drain body positioned over at least a portion of the inlet wherein the cover is secured to the drain body with at least one shock arrestor; and a screen positioned between the inlet and the cover.

2. The roof drain of claim 1 wherein the cover is a dome.

3. The roof drain of claim 2 wherein a hole is positioned in the apex of the cover.

4. The roof drain of claim 1 wherein the drain body further comprises a flange around the inlet and an inner ledge positioned between the inlet and the outlet.

5. The roof drain of claim 4 further comprises an insert positioned within the drain body between the inlet and the inner ledge.

6. The roof drain of claim 5 wherein the at least one shock arrestor is positioned to compress between the tapered insert and the cover.

7. The roof drain of claim 6 wherein the screen is made of a compressible material.

8. The roof drain of claim 7 wherein the screen has a diamond mesh pattern.

9. The roof drain of claim 4 further comprising a roof clamp removably secured to the flange of the drain body.

10. The roof drain of claim 4 wherein the cover has a larger diameter than the flange.

11. A roof drain comprising:

a cylindrical drain body having an inlet tapering to an inner ledge and an outlet wherein the cover is secured to the drain body with at least one shock arrestor;

a cover secured to the drain body positioned over at least a portion of the inlet;

a screen positioned between the inlet and the cover; and a roof clamp removably secured to the drain body.

12. The roof drain of claim 11 wherein the cover is a dome.

13. The roof drain of claim 12 wherein a hole is positioned in the apex of the cover.

14. The roof drain of claim 13 further comprises a tapered insert positioned within the drain body between the inlet and the inner ledge.

15. The roof drain of claim 14 wherein the at least one shock arrestor is positioned to compress between the tapered insert and the cover.

16. The roof drain of claim 15 wherein the screen is made of a compressible material.

17. The roof drain of claim 16 wherein the screen has a diamond mesh pattern.

18. The roof drain of claim 11 wherein the cover has a larger diameter than the drain body.

* * * * *